US006287742B1

(12) United States Patent
Yoon

(10) Patent No.: US 6,287,742 B1
(45) Date of Patent: Sep. 11, 2001

(54) TONER COMPOSITIONS AND METHOD OF PRODUCING TONER FOR DEVELOPING LATENT ELECTROSTATIC IMAGES

(75) Inventor: Hyun-Nam Yoon, Towaco, NJ (US)

(73) Assignee: MatSci Solutions, Inc., Towaco, NJ (US)

( * ) Notice: Subject to any disclaimer, the term of this patent is extended or adjusted under 35 U.S.C. 154(b) by 0 days.

(21) Appl. No.: 09/571,772

(22) Filed: May 16, 2000

(51) Int. Cl.[7] ..... G03G 9/08
(52) U.S. Cl. ..... 430/137.19; 430/110.3
(58) Field of Search ..... 430/137, 106, 430/110, 111, 137.19, 110.3

(56) References Cited

U.S. PATENT DOCUMENTS

| | | | |
|---|---|---|---|
| 2,297,691 | 10/1942 | Carlson . | |
| 3,590,000 | 6/1971 | Palermiti et al. | 252/62.1 |
| 4,298,672 | 11/1981 | Lu | 430/108 |
| 4,338,390 | 7/1982 | Lu | 430/106 |
| 4,645,727 | 2/1987 | Ong et al. | 430/106 |
| 4,778,742 | 10/1988 | Ong et al. | 430/106 |
| 5,102,761 | 4/1992 | Ohsaki et al. | 430/106 |
| 5,114,821 | 5/1992 | Haack | 430/110 |
| 5,200,290 | 4/1993 | Ong et al. | 430/115 |
| 5,212,033 | 5/1993 | Tsubota et al. | 430/106 |
| 5,227,460 | 7/1993 | Mahabadi | 528/272 |
| 5,296,325 | 3/1994 | Ohtsuka et al. | 430/106 |
| 5,352,521 | 10/1994 | Hotta et al. | 428/402 |
| 5,376,494 | 12/1994 | Mahabadi | 430/137 |
| 5,437,953 | 8/1995 | Russell et al. | 430/106 |
| 5,470,687 | 11/1995 | Mayama et al. | 430/137 |
| 5,500,321 | 3/1996 | Kasuya et al. | 430/109 |
| 5,565,298 | 10/1996 | Suguro et al. | 430/137 |
| 5,693,444 | 12/1997 | Takagi et al. | 430/106.6 |
| 5,866,662 | 2/1999 | Hatke et al. | 526/160 |
| 6,001,524 * | 12/1999 | Yoon et al. | 430/106 |
| 6,156,473 * | 12/2000 | Tyagi et al. | 430/137 |

FOREIGN PATENT DOCUMENTS

| | | | |
|---|---|---|---|
| 1373531 | 11/1974 | (GB) | C08G/20/20 |

OTHER PUBLICATIONS

Powder Technology Handook, 2nd edition, Marcell Dekker PUblications (1997), pp. 3–13, K. Gotoh et al.

* cited by examiner

*Primary Examiner*—John Goodrow
(74) *Attorney, Agent, or Firm*—Michael W. Ferrell

(57) ABSTRACT

A process for producing microspheric toner particles suitable for color toner applications includes forming coarse particles of an amorphous polymer with one or more pigments and optionally a charge control agent followed by reducing the particle size such that it is suitable as toner for high resolution electrostatic imaging. A step of comminuting the particles includes forming a dispersion of the particles in a liquid organic medium and applying shear in the presence of a surfactant. In another embodiment, the invention discloses a process for producing microspheric particles of substantially amorphous resin with an average diameter in the range of from about 2 to about 10 microns. Preferred resins include amorphous polyester resins and ethylene/norbornene copolymers.

45 Claims, No Drawings

TONER COMPOSITIONS AND METHOD OF PRODUCING TONER FOR DEVELOPING LATENT ELECTROSTATIC IMAGES

FIELD OF THE INVENTION

This invention generally relates to toner compositions and a method of producing toners for developing latent electrostatic images in electrophotography, electrostatic recording and electrostatic printing. More specifically, this invention relates in a preferred embodiment to a method of forming suitably sized resin particles which incorporate coloring agents and other components therein for high-resolution color electrophotography, electrostatic recording and electrostatic printing. Preferred resins include amorphous polyesters and ethylene/norbornene copolymers.

BACKGROUND OF THE INVENTION

The formation and development of images on the surface of photoconductive materials by electrostatic means is well known. The basic electrophotographic imaging process (U.S. Pat. No. 2,297,691) involves placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or over coating treatment.

Also well known are techniques to develop such electrostatic images. Developer is a vehicle in which are dispersed charged colored toner particles. The photoreceptor bearing the electrostatic latent image is contacted with the developer. The contact causes the charged toner particles in the developer to migrate to the charged areas of the photoreceptor to develop the latent image. Then, the photoreceptor is developed with the charged colored particles adhering to the latent image in image configuration. The developed image is then typically transferred to a suitable substrate, such as paper or transparency material, and optionally may be fixed to the substrate by heat, pressure or other suitable means.

Electrostatic images formed on an electrophotographic photoconductor and an electrostatic recording medium are generally developed by using (i) a mono-component type dry developer consisting of a toner comprising a coloring agent such as a dye or pigment and a binder resin in which the coloring agent is dispersed, or with addition of a charge controlling agent thereto when necessary, or (ii) a two-component type dry developer comprising the above-mentioned toner and solid carrier particles. Toners and developer compositions including colored particles are well known. In this regard, see U.S. Pat. Nos.: 5,352,521; 4,778,742; 5,470,687; 5,500,321; 5,102,761; 4,645,727; 5,437,953; 5,296,325 and 5,200,290 the disclosures of which are hereby incorporated by reference. The traditional compositions normally contain toner particles consisting of resin and colorants, wax or a polyolefin, charge control agents, flow agents and other additives. A typical toner formulation generally contains about 90–95 weight percent resin, about 2–10 weight percent colorant, 0-about 6 weight percent wax, 0-about 3 weight percent charge control agent, about 0.25 –1 weight percent flow agent and 0-about 1 weight percent other additives. Major resins are styrene-acrylic copolymers, styrene-butadiene copolymers and polyesters. The colorants usually are selected from cyan dyes or pigments, magenta dyes or pigments, yellow dyes or pigments, and mixtures thereof.

Conventional color toners are produced by a milling process described, for example, in the aforementioned U.S. Pat. No, 5,102,761. In that process, a polyacrylate resin is compounded with pigments, charge control agents ("CCA") and occasionally wax in a melt mixer. The resulting polymer mixture is mechanically crushed and then milled into small particles. The conventional toner particles typically have an irregular shape and a broad distribution in particle size. For optimum resolution of images and color, smaller particles perform better. Thus, for example, it is difficult to obtain resolutions better than about 600 dots/inch when the average particle size is more than about 7 $\mu$m. For resolutions in the order of about 1200 dots/inch, particle sizes smaller than 5 $\mu$m are typically needed. It is difficult to make particles smaller than about 7–10 $\mu$m by conventional processes because of the high energy cost of producing small particles as well as uniform narrow particle size distribution.

Improvements to cure such deficiencies have been attempted in the past. For example, the aforementioned U.S. Pat. Nos. 5,352,521, 5,470,687 and 5,500,321 disclose toner particles produced by dispersion polymerization. In such method, monomers (typically styrenic and acrylate monomers) and additives such as pigments, CCA and wax are mixed together to form a dispersion. This is then further dispersed into an aqueous or a non-aqueous medium and the monomers are reacted to form toner particles. This method has the advantage over other methods that spherical toner particles with a small diameter can be prepared by a single process. However, the polymerization involves a substantial volume contraction and it results in entrapment of the dispersion medium inside the toner particles. Furthermore, the polymerization is difficult to be brought to completion and a substantial portion of the monomers remains in the toner particles. The residual monomers and the entrapped dispersion solvent are difficult to separate from the particles. Also, the polarity of the polymerizing materials changes drastically in the course of the polymerization and the additives tend to exude from the particle bulk and tend to concentrate on the surface thereof. Further, agents employed, such as dispersion-stabilizing agent and surface active agent, which cause the charging characteristics and preservability of the toner particles to deteriorate, remain on the surface of the toner particles, and those agents are extremely difficult to remove from the toner particles.

There is continuing interest in the development of new and improved methods of producing toners for application in high-resolution color electrophotography. Accordingly, an object of the present invention is to provide a method of producing high-resolution color toner which has a superior combination of properties for electrophotographic imaging systems by dispersing a pigment and other additives in a polymer resin and forming spherical toner particles with a small diameter by dispersing a compounded polymer resin in a dispersion medium including a surfactant under a vigorous shearing condition.

Other objects and advantages of the present invention shall become apparent from the accompanying description and examples.

SUMMARY OF THE INVENTION

There is provided in accordance with one aspect of the present invention a process for preparing a particulate toner composition for developing latent electrostatic images including the steps: (a) preparing a first particulate resin composition including a resin component and a pigment component, and optionally including a charge control agent; (b) dispersing the first particulate pigmented resin composition in an organic medium including a surfactant, wherein the resin is substantially insoluble in the organic medium; (c) comminuting the first particulate resin composition in the organic medium by way of application of shear thereto at an elevated temperature; and (d) recovering the comminuted particulate toner composition from the organic medium. In a particularly preferred aspect, the toner particles are substantially spherical in shape and have a volume average diameter in the range of from about 1 to about 10 microns with at least 95 percent of the particles having a diameter in the range of from about 2 to about 15 microns. Comminuting the particles is typically carried out at a temperature of from about 30° C. to about 150° C. above the glass transition temperature of the resin component of the first particulate resin composition. Any suitable polymer resin may be employed. Particularly preferred resins include polyester resins, cycloolefin copolymer resins, and styrene based resins. When polyester resins are employed the polymer resin is typically an amorphous resin with a glass transition temperature in the range of from about 40° C. to about 90° C. having a weight average molecular weight in the range of from about 5000 g/mol to about 40,000 g/mol.

The first particulate resin composition is typically prepared by melt compounding the resin component with the pigment component and optionally with a charge control agent. The pigment component is typically selected from cyan pigments, yellow pigments, magenta pigments and black pigments. The pigment component may be a master batch in which the pigment is predispersed in the resin. Master batches may be produced by any suitable technique such as by flushing a solvent from a mixture including the pigment, a solvent and the resin. The charge control agent may be dispersed in the resin in a molten state and may be a positive charge control agent or a negative charge control agent. The first particulate resin composition may be prepared by melt compounding wherein the mixture is cooled and then pulverized to form relatively coarse particles having an average size in the range of from about 50 to about 200 microns, whereas the comminuted particulate toner composition typically has a volume average particle size of from about 2 to about 10 microns. Particularly preferred particle size ranges for the toner composition include those having a volume average particle size of from about 2 to about 4 microns and those toner compositions having a volume average particle size of from about 5 to about 8 microns. Typically at least about 80 percent of the particles of the toner composition are within from about 0.5 to about 1.5 times the average particle size of the toner composition.

The solubility parameter of the organic medium is generally different from the solubility parameter of the resin component by at least about 1. In preferred embodiments the solubility parameter of the organic medium is larger or smaller than the solubility parameter of the resin component by at least about 2. Any suitable organic medium which does not dissolve the resin component may be employed. Particularly preferred solvents include paraffin solvents and poly (ethylene glycol). The organic medium includes a surfactant such as a non-ionic surfactants which may be made utilizing ethylene oxide or propylene oxide.

The surfactant is generally present in the organic medium in an amount from about 0.2 to about 15 weight percent based on the amount of solvent present whereas from about 1 to about 10 weight percent based on the amount of solvent present is typical.

The first particulate resin composition is generally from about 10 to about 70 volume percent of the combined volume of the resin composition in the organic medium during the step of comminuting the particles. From about 20 to about 50 volume percent of the combined volume of the first particulate resin composition in the organic medium is more typical.

During the step of comminuting the particles, the organic medium is maintained at an elevated temperature which is higher than the glass transition temperature of the resin component of the first particulate resin composition. While any suitable elevated temperature may be employed, preferred temperatures are at least about 30° C. higher than the glass transition temperature of the resin component of the first particulate resin composition. This temperature is typically maintained for between about 5 and 60 minutes while the particles are comminuted.

A flow improvement agent, such as fume silica, may be added to the toner composition, typically after the particles have been comminuted.

In another aspect of the present invention, there is provided a particulate toner composition including pigmented toner resin particles that are substantially spherical in shape, have an average diameter of from about 1 to about 10 microns, with at least about 95 percent of the particles having a volume average diameter in the range of from about 2 to about 15 microns prepared by comminuting a precursor composition in an organic medium under shear at an elevated temperature wherein the particles are substantially insoluble in the organic medium. The resin may be a polyester resin, a cycloolefin copolymer or a styrene base polymer. When cycloolefin copolymers are employed a particularly preferred resin is a norbornene/ethylene copolymer. The developer compositions may be further include carrier particles. Such particles are typically selected from the group consisting of ferrite, steel, iron powder, and mixtures thereof, wherein the powders have a surface active agent coated thereon.

In still yet another aspect of the present invention, there is provided a particulate toner composition including a polyester resin component and a pigment component wherein the particles are substantially spherical in shape and have a volume average diameter in the range of from about 1 to about 10 microns with at least 95 percent of the particles having a diameter in the range of from about 2 to about 15 microns and wherein the polyester resin component includes a polyester resin having a weight average molecular weight of about 40,000 g/mol or less.

In a still further aspect of the present invention, there is provided a particulate toner composition including a cycloolefin copolymer resin component and a pigment component wherein the particles are substantially spherical in shape and have a volume average diameter in the range of from about 1 to about 10 microns with at least about 95 percent of the particles having a diameter in the range of from about 2 to about 15 microns and wherein the cycloolefin copolymer resin component includes a cycloolefin copolymer having a weight average molecular weight of about 40,000 g/mol or less. Particularly preferred cycloolefin copolymer resins include norbornene based copolymers.

DETAILED DESCRIPTION OF THE PREFERRED EMBODIMENTS

Illustrative examples of suitable toner resins selected for the toner and developer compositions of the present invention include thermoplastics such as polyamides, polyolefins, styrene acrylate, styrene methacrylates, styrene butadienes, cross-linked styrene polymers, ethylene-cycloolefin copolymers, and epoxies, polyurethanes, vinyl resins, including homopolymers or copolymers of two or more vinyl monomers; and polyesters generally, such as the polymeric esterification products of a dicarboxylic acid and a diol comprising a diphenol, reference the known linear polyesters, the polyesters of U.S. Pat. No. 3,590,000, the disclosure of which is totally incorporated herein by reference, and the like. Of the above resin, polyester copolymers, styrene-acrylic copolymers and ethylene-cycloolefin copolymers are more preferable for use in the present invention.

Polyester resins suitable for the inventive process is a linear polyester, having repeat units of the general formula:

$$-[P^1]_a-[P^2]_b-[P^3]_c-$$

where $P^1$ is a monomer moiety representing residues of a dicarboxylic acid moiety, $P^2$ is a monomer moiety representing residues of a diol moiety, and $P^3$ is a monomer moiety representing residues of a hydroxycarboxylic acid moiety. The units a, b, and c represent mole percent of the respective monomeric moiety, with a and b are independently equal to 20–49.5 mole percent and c equals 0–99 mole percent.

The dicarboxyl component forming $P^1$ is selected from a variety of sources such as, for example, carboxylic acids, acid chlorides, esters and the like, as is well known to those skilled in the art. Examples of such dicarboxylic moieties suitable for $P^1$ include, but are not limited to, terephthalic acid, isophthalic acid, fumaric acid, succinic acid, glutaric acid, adipic acid, sebacic acid, cyclohexane dicarboxylic acid, naphthalene dicarboxylic acid, 1,2-bis(4-carboxyphenoxy)-ethane, and combinations thereof. The diol component forming the $P^2$ part of the polyester is selected from a variety of diol sources. Examples of suitable diol moieties include, but are not limited to, ethylene glycol, isomers of propylene glycol, isomers of butylene glycol, isom g/mol ers of pentane diol, isomers of hexane diol, isomers of cyclohexane dimethanol, 2-methyl-1,3-propanediol, 5-neopentyl glycol, bisphenol A-ethylene oxide condensate, bisphenol A--propylene oxide condensate and combinations thereof.

The hydroxycarboxylic acid component $P^3$ is derived from monomers derived from, for example, glycolic acid, lactic acid, scaprolactone, γbutyrolactone, 6-butyrolactone, propiolactone, hydroxypivalic acid, lactone of hydroxypivalic acid, and combinations thereof.

As one preferred toner resin, there can he selected the esterification products of a dicarboxylic acid and a diol comprising a diphenol, such as Fine Tone™ polyesters available from Reichhold Chemicals, Inc., Research Triangle park, N.C. 27709. These resins are generally illustrated in U.S. Pat. No. 3,590,000, the disclosure of which is incorporated herein by reference. Other specific toner resins include styrene-methacrylate copolymers, and styrene-butadiene copolymers; suspension polymerized styrene-butadienes; ethylene-cycloolefin copolymers; polyester resins obtained from the reaction of bisphenol A and propylene oxide; followed by the reaction of the resulting product with fumaric acid; and branched polyester resins resulting from the reaction of dimethylterephthalate, 1,3-butanediol, 1,2-propanediol, and pentaerythritol; and mixtures thereof.

Also, a blend of polyesters as illustrated in U.S. Pat. Nos. 5,376,494 and 5,227,460 can be selected as the toner resin. More specifically, these polyesters are comprised of cross-linked and linear portions, the cross-linked portion consisting essentially of microgel particles with an average volume particle diameter up to 0.1 micron, preferably about 0.005 to about 0.1 micron, the microgel particles being substantially uniformly distributed throughout the linear portions. The blended polyesters in embodiments are comprised of cross-linked portions consisting essentially of microgel particles, preferably up to about 0.1 micron in average volume particle diameter.

Any suitable cycloolefin copolymer resin maybe employed in connection with the present invention. Suitable cycloolefin polymers typically include polymerized units of polycyclic olefin having a norbornene base structure, particularly norbornene or tetracyclododecene. These polymers also have polymerized units of acyclic olefins such as alphaolefins. A particularly preferred alphaolefin is ethylene. In some instances the resins have an olefinically unsaturated end group having at least three carbon atoms as disclosed, for example, in U.S. Pat. No. 5,866,662, the disclosure of which is incorporated herein by reference in its entirety. In particularly preferred embodiments these resins have a weight average molecular weight of less than about 40,000 g/mol and more particularly of less that about 20,000 g/mol.

In some embodiments, the number-average molecular weight ($M_n$) of the toner resin as measured by gel permeation chromatography (GPC) is in the range typically from about 1,000 g/mol to about 20,000 g/mol, and preferably from about 2,000 g/mol to about 5,000 g/mol. The weight-average molecular weight ($M_w$) of the linear portion is in the range typically from about 2,000 g/mol to about 40,000 g/mol, and preferably from about 4,000 g/mol to about 15,000 g/mol. The molecular weight distribution ($M_w/M_n$) of the linear portion is in the range typically from about 1.5 to about 6, and preferably from about 2 to about 4. The onset glass transition temperature ($T_g$) of the linear portion as measured by differential scanning calorimetry (DSC) is in the range typically from about 50° C. to about 90° C., and preferably from about 50° C. to about 70° C. Melt viscosity of the resin as measured with a dynamic mechanical spectrometer at 10 radians per second is from about 5,000 to about 200,000 poise, and preferably from about 20,000 to about 100,000 poise at 100° C., and drops sharply with increasing temperature to from about 100 to about 5,000 poise, and preferably from about 400 to about 2,000 poise, as the temperature rises from 100° C. to 140° C.

Also, as indicated herein there can be included in the toner compositions of the present invention low molecular weight waxes, such as polypropylenes and polyethylenes commercially available from EPOLENE N-15™ commercially available from Eastman Chemical Products, Inc., and similar waxes. The commercially available polyethylenes selected have a molecular weight of from about 1,000 g/mol to about 1,500 g/mol, while the commercially available polypropylenes utilized for the toner compositions of the present invention are believed to have a molecular weight of from about 4,000 g/mol to about 7,000 g/mol.

The low molecular weight wax materials are present in the toner composition of the present invention in various amounts, however, generally these waxes are present in the toner composition in an amount of from about 0 percent by weight to about 15 percent by weight, and preferably in an amount of from about 2 percent by weight to about 10 percent by weight.

As the colorant used in the present invention, commonly known pigments may be used. Illustrative black pigments may include carbon black, aniline black, nonmagnetic ferrite and magnetite. Illustrative cyan pigments may include copper phthalocyanine compounds and derivatives thereof;

anthraquinone compounds, and basic dye chelate compounds. Particularly preferred cyan pigments are C.I. Pigment Blue 1, 7, 151, 152, 153, 154, 60, 62, and 66. Illustrative magenta pigments may include condensation azo compounds, diketopyropyrrole compounds, anthraquinone compounds, quinacridone compounds, basic dye chelate compounds, naphthol compounds, benzimidazole compounds, thioindigo compounds and perylene compounds. Particularly preferred magenta pigments are C.I. Pigment Red 2, 3, 5, 6, 7, 23, 482, 483, 484, 811, 122, 146, 166, 169, 177, 184, 185, 202, 206, 220, 221, and 254. Illustrative yellow pigments may include condensation azo compounds, isoindolinone compounds, anthraquinone compounds, azo metal complexes, methine compounds, and allylamide compounds. Particularly preferred yellow pigments are C. I. Pigment Yellow 12, 13, 14, 15, 17, 62, 74, 83, 93, 94, 95, 109, 110, 111, 128, 129, 147, 168 and 180.

The colorants are selected taking account of hue, chroma, brightness, weatherability, transparency and dispersibility in toner resins. The colorants may be used alone, in the form of a mixture, or in the state of a solid solution. Further, the colorant particles may be coated with a polymer film to facilitate dispersion of the particles in toner resins. The colorants may be added in the amount of from 1 to 20 parts by weight based on 100 parts by weight of the resin.

Various known suitable effective positive or negative charge controlling additives (CCA) can be selected for incorporation into the toner compositions of the present invention, preferably in an amount of about 0.1 to about 10, more preferably about 1 to about 3, percent by weight. Examples include quaternary ammoniumn compounds inclusive of alkyl pyridinium halides, alkyl pyridinium compounds, reference U.S. Pat. No. 4,298,672, the disclosure of which is totally incorporated herein by reference; organic sulfate and sulfonate compositions, U.S. Pat. No. 4,338,390, the disclosure of which is totally incorporated herein by reference; bisulfonates; ammonium sulfates (DDAES); distearyl dimethyl ammonium bisulfate (DDAMS), reference U.S. Pat. No. 5,114,821, the disclosure of which is totally incorporated herein by reference; cetyl pyridinium tetrafluoroborates; distearyl dimethyl ammonium methyl sulfate, aluminum salts, such as BONTRON E84™ or E88™ (Oriental Chemicals); quaternary ammonium nitrobenzene sulfonates; mixtures of charge enhancing additives, such as DDAMS and DDAES; other known charge additives; and the like. Moreover, effective known internal and external additives may be selected for the toners of the present invention in embodiments thereof.

In the present invention, it is preferable that the amount of the CCA is 0.1 to 10 parts by weight to 100 parts by weight of the dyed resin particles for appropriately controlling the triboelectric charging characteristics of the toner particles and image fixing performance, although the above ratio can be varied, depending upon the charge quantity required for the toner particles or a development means for use with the toner particles.

The inventive method of producing high-resolution color toner comprises the steps of (1) dispersing a pigment and additives such as a charge control agent in a polymer resin in the molten state; (2) pulverizing the compounded resin into coarse particles; (3) preparing a bath comprising a mixture of an organic solvent which does not dissolve the resin and a surface active agent; (4) dispersing said resin particles in said bath; (5) maintaining the dispersion at an elevated temperature and under a vigorous shearing condition for an extended period of time until the average particle diameter attains an equilibrium value determined by the amount of the surfactant; and (6) removing the organic solvent from the dispersion.

For the method of uniformly dispersing and blending the resins, colorants and charge control agents, conventionally known methods such as melt-kneading in a sealed kneader and melt-mixing in a double screw extruder. The kneaded or blended mixture, after cooling, may be pulverized to form coarse particles with the average size in the order of 100 microns using a ball mill, a hammer mill or an air jet mill. Colored particles with a substantially spherical shape and a small diameter in the range of 3 to 15 microns may be obtained by dispersing said coarse resin particles in a solvent comprising a non-solvent for said resin and a suitable surfactant.

It is preferable to employ a solvent in which the resin particles are not dissolved, or in which the resin particles slightly swell with the solvents for the particle forming operation of this invention. More specifically, it is preferable that the solubility parameter value of the solvents differs from that of the resin particles by 1.0 or more, more preferably 2.0 or more. For example, it is preferable to employ a non-polar organic solvent having a low solubility parameter value such as paraffins, paraffinic esters, paraffinic amides and paraffinic ethers in combination with polyester resin particles. In contrast, when a highly polar solvent such as water, methanol, propanol, and acetone is employed as a solvent for the particle forming process, significant coalescence of the particles occurs. On the other hand, when non-polar resins such as ethylene-cycloolefin copolymers are used as the binder resin for toner, it is preferable to use a polar solvent such as poly-(ethylene glycol) with the number average molecular weight leas than 1,000. If a non-polar solvent such as paraffins, paraffinic esters, paraffinic amides and paraffinic ethers is employed in the particle forming process for the non-polar cycloolefin copolymers, substantial swelling and coalescence of the particle occurs.

A surfactant is used in conjunction with the aforementioned non-solvent in the particle forming process of this invention. The surfactant performs two important functions for successful formation of small toner particles. First, it prevents coalescence of the resin particles during the process. In the inventive process, the process is carried out generally at a temperature substantially higher than the glass transition temperature of resin. Thus, in the absence of the surfactant, the particles are in the molten state, tend to coalesce in an uncontrollable manner and thus fail to reduce the particle size to a level suitable for a high-resolution toner. Secondly, the relative amount of surfactant to the amount of resin particles in the bath determines the particle size. The surfactants, because of their chemical structures, tend to concentrate at the interface between the non-solvent and the molten particulate resins. Therefore, a larger amount of surfactant tends to produce smaller particles and a smaller amount tends to produce larger particles. The surfactant may be anionic, cationic or non-ionic. It is preferable that the surfactant is non-ionic.

The weight ratio of the surfactant to the non-polar solvent can be selected as desired depending on the amount of the resin particle to be processed and the desired particle size. However, generally it is preferable that the amount of the surfactant is in the range of 0.1 to 10 parts by weight to 100 parts by weight of the non-polar solvent. The amount of the total liquid medium in dye bath to the resin to be dyed can be selected as desired. However, generally it is preferable that the amount of the solvent is in the range of 50 to 1000 parts by weight to 100 parts by weight of the resin particles to be processed.

In the present invention, small particles suitable for high resolution toners are produced by a dispersion process. The coarse particles are dispersed into a disperser containing one of more non-solvents and surfactants described above at ambient temperature. A preferred dispersor is an impeller type such as a Henschel mixer (marketed by Henschel Mixer America, 4500 S. Pinemont, Houston, Tex.). Temperature of the dispersion is then raised substantially higher than the glass transition temperature of the resin while the dispersion is subjected to a vigorous shearing action. A temperature in the range of about 30–150° C. above the glass transition temperature is preferred for the present invention. When the temperature reaches a desired level, the dispersion is maintained at a high shearing condition for an extended period. At the high temperature, the resin particles melt. The shearing action induces break-up of the molten resin particles into smaller particles and the surfactant molecules coat the surfaces of the smaller particles thereby preventing the particles to coalesce back into larger particles. The break-up of particles into smaller particles continue until the particle size reaches an equilibrium value determined by the amount of surfactant relative to that of total resin in the disperser. The dispersion is then allowed to cool below the glass transition temperature and the shearing action is stopped. The toner particles are then filtered, entrained dispersant is washed off the particles using a hydrocarbon solvent and the wash solvent is dried off the particles to produce the toners of the present invention.

The toner particles may then be coated with a suitable flowability improvement agent. They generally help to enhance the flowability of the particles during their use as color toner. Suitable flow agents are materials such as finely-divided particles of hydrophobic silica, titanium oxide, zinc stearate, magnesium stearate and the like which may be applied by processes such as, for example, dry mixing, solvent mixing and the like. In a typical process, a hydrophobic fumed silica (previously treated with a surface activating reagent such as, for example, hexamethyldisilazane and available under the trade name Cab-O-Sil®T-530 from Cabot Corporation, Tuscola, Ill.) is mixed with the CCA-coated particles and blended well in a tumble mixer for about 10–60 minutes to obtain flow agent-coated toner particles.

In the present invention, it is preferable to produce small toner particles which have a volume average particle size (L) in the range 3–15 $\mu$m. The terms "volume average particle size" is defined in, for example, *Powder Technology Handbook,* 2nd edition, by *K. Gotoh et al*, Marcell Dekker Publications (1997), pages 3–13. More specifically, it is preferable to produce toner particles which include particles with a particle size distribution in the range of 0.75×L to 1.25×L in an amount of 85 wt. % or more of the entire weight of the particles. This is because the toner particles with such a narrow particle size distribution provide toner particles which have uniform quantity of electric charge in each toner particle, and can provide high-quality copy images and for which charge control is easy in a development unit.

In the present invention, the particle size distribution is measured by a commercially available Coulter LS Particle Size Analyzer (made by Coulter Electronics Co., Ltd., St. Petersburg, Fla.).

The toners in this invention can be formulated into developer compositions by the mixing thereof with carrier particles. Illustrative examples of carriers that can he selected for mixing with the toner compositions include those carriers that are capable of triboelectrically obtaining a charge of opposite polarity to that of the toner particles. Accordingly, in embodiments the carrier particles may be selected so as to be of a negative or of a positive polarity in order that the toner particles, which are positively or negatively charged, will adhere to and surround the carrier particles. Illustrative examples of carriers include granular zircon, granular silicon, glass, steel, iron, nickel. ferrites, such as copper zinc ferrites, copper manganese ferrites, and strontium hexaferrites, silicon dioxide, and the like. In embodiments, mixtures of coatings, such as KYNAR® and PMMA as illustrated in U.S. Pat. Nos. 4,937,166 and 4,935,326, mixtures of three polymers, mixtures of four polymers, polymer mixture pairs wherein each pair contains a conductive carrier coating and an insulating earner coating, can be selected. The carrier coating can be selected in various effective amounts, such as for example from about 0.1 to about 10, and preferably from about 1 to about 3 weight percent. Also, in embodiments the carrier core may he entirely coated on the surface thereof, or partially coated.

Furthermore, the diameter of the carrier particles, preferably spherical in shape, is generally from about 50 microns to about 1,000, and preferably from about 60 to about 100 microns thereby permitting them to possess sufficient density and inertia to avoid adherence to the electrostatic images during the development process. The carrier component can be mixed with the toner in various suitable combinations, such as from about 1 to 5 parts toner to about 100 parts to about 200 parts by weight of carrier.

The features of the present invention will become apparent in the course of the following description of examples, which are given for illustration of the invention and are not intended to be limiting thereof.

EXAMPLE 1

C.I. Pigment Blue 15:3 having a Color Index Constitution Number 74160 (Heliogen™Blue D7100 obtainable from BASF Corp., Charlotte, N.C.) and a negative charge control agent (Bontron™E-88 available from Orient Chemical Corporation, Springfield, N.J.) are dispersed in a propoxylated bisphenol-A polyester resin (Fine Tone™382ES commercially available from Reichold Chemicals, Incorporated, Research Triangle Park, N.C.) by using the following procedure. In an Aaron Process Company lab mixer equipped with a two horsepower direct connect gear motor and mixing blades of sigma design with front blade speed set at 60 RPM and back blade speed set at 34 RPM, 2,000 grams of the polyester resin is charged and heated to 140° C. until the resin is completely molten and freely flowing. C.I. Pigment Blue 15:3 particles are added in three aliquots to the molten resin. A total of 100 grams of C.I. Pigment Blue 15:3 is added to the resin. 20 grams of Bontron E-88 charge control agent (CCA) is added to the resin/pigment mixture. The mixture of resin/pigment/CCA is further mixed for one hour at 140° C. The mixture is then cooled and pulverized in a ball mill (available from Paul O. Abbe, Inc., Little Falls, N.J. 07424) to coarse particles with a number averaged size of approximately 70 microns.

Into a 2000-ml round-bottom flask equipped with an impeller-type agitator, 500 grams of Isopar-L®, 12.5 grams of Ganex V-220 and 500 grams of the above coarse particles are charged. The mixture is then heated to 140° C. and maintained at the temperature for 60 minutes under agitation at 100 rpm. The mixture forms a milky dispersion and the dispersion is then allowed to cool down to ambient temperature. The treated particles are separated from the reaction mixture by filtration and the entrained solvent in the filter cake is washed off by dispersing the filter cake in isohexane and filtered again. The filtered particles are dried at 40° C. under vacuum for 16 hours. 100 parts by weight of the dry particles are blended with 1 parts by weight of Cab-O-Sil®TG-308F (a fumed silica acting as a flowability improvement aid from Cabot Corporation, Tuscola, Ill.) for 15 minute in a roll mill, whereby a cyan toner No. 1 is obtained according to the present invention.

The resulting cyan toner contains 95.3 wt. percent of the polyester resin and 4.7 wt. percent of C.I. Pigment Blue 15:3, which pigment have a particle size of 0.1 micron average particle diameter as measured by transmission electron microscopy. When the particle size is determined, the number average particle size is significantly reduced to 4.2 microns. Scanning electron microscopy examination of the toner particles shows that the particles are spherical with smooth surface texture.

EXAMPLE 2

Into a 2000-ml round-bottom flask equipped with an impeller-type agitator, 500 grams of Isopar-L®, 7.5 grams of Ganex V-220 and 500 grams of the coarse resin particles of Example 1 are charged. The mixture is subjected to the same process as in Example 1 to produce Cyan Toner No. 2 according to the present invention.

The resulting Cyan Toner No. 2 contain 95.3 wt. percent of the polyester resin and 4.7 wt. percent of C.I. Pigment Blue 15:3, which pigment have a particle size of 0.1 micron average particle diameter as measured by transmission electron microscopy. When the particle size is determined, the number average particle size is significantly reduced to 7.4 microns.

EXAMPLE 3

A magenta toner is prepared using C.I. Pigment Red 81:3 (Rhodamine YS PMA commercially available from Magruder Color Company, Elizabeth, N.J.) in place of the C.I. Pigment Blue 15:3 by following the same procedure as in Example 1.

The resulting magenta toner contain 95.3 wt. percent of the polyester resin and 4.7 wt. percent of C.I. Pigment Red 81:3. Scanning electron microscopy examination of the toner particles shows that the particles are substantially spherical in shape and the number average diameter is 4.4 microns.

EXAMPLE 4

Repeating the procedure of Example 1, a yellow toner is prepared using C.I. Pigment Yellow 185 (Enceprint Yellow 1155 commercially available from BASF Corporation, Charlotte, N.C.) in place of the C.I. Pigment Blue 15:3.

The resulting yellow toner contain 95.3 wt. percent of the polyester resin and 4.7 wt. percent of C.I. Pigment Yellow 185. Examination of the toner particles with scanning electron microscopy reveals that the particles are substantially spherical in shape and the number average diameter is 4.4 microns.

EXAMPLE 5

A black toner is prepared following the same process as in Example 1. C.I. Pigment Black 7 (Carbon Black V commercially available from ICI America, Newark, Del.) is used in place of C.I. Pigment Blue 15:3.

The resulting black toner contain 95.3 parts of the polyester resin and 4.7 parts of the carbon black. The number average diameter of the toner particles is 4.7 microns.

EXAMPLE 6

C.I. Pigment Blue 15:3having a Color Index Constitution Number 74160 (Heliogen™ Blue D7100 obtainable from BASF Corp., Charlotte, N.C.) and a negative charge control agent (Bontron™ E-88 available from Orient Chemical Corporation, Springfield, N.J.) is dispersed in a cycloolefin copolymer resin (a copolymer of norbonene and ethylene in the molar ratio of 60 to 40 with the weight average molecular weight of 11,000 and the number average molecular weight of 5,900 and the glass transition temperature of 65° C.) by using the following procedure. In an Aaron Process Company lab mixer equipped with two horsepower direct connect gear motor and mixing blades of sigma design with front blade speed set at 60 RPM and back blade speed set at 34RPM, 1,600 grams of the cycloolefin copolymer resin plus 160 grams of toluene are mixed and heated to 80° C. until the resin is completely dissolved. The D.I. Pigment Blue 15:3 is added in three aliquots to the mix in the wet cake form which is a 50:50 weight ratio of Pigment Blue 15:3 and water as follows: 1,000 grams of D.I. Pigment Blue 15:3 wet cake (which contains 50 percent of water) are added to the resin/toluene mixture. The water from the wet cake pigment is displaced by the resin/toluene solution (flushed) and the water is decanted. Another 567 grams of the same wet cake is added to the mixture, allowed to mix, and the water is displaced from the pigment and decanted. Finally, the last aliquot of wet cake, 567 grams, is added and allowed to mix with the resin/toluene, and for a third time the water is displaced from the pigment, and again the water is decanted. The mixture of resin/toluene/pigment is further mixed for one hour at 80° C. The mixture is then subjected to vacuum to remove the toluene and any entrapped water from the resin/pigment mixture. The mixture is then cooled and crushed to a powder. The resulting D.I. Pigment Blue 15:3 mater batch contains 60/40 weight ratio of resin/pigment.

The above prepared master batch is further blended with the above cycloolefin copolymer resin utilizing a Haake twin screw mixer (commercially available from Haake Fison, Inc., Paramus, N.J.). A mixture of 90 parts of the cycloolefin copolymer resin and 10 parts of the D.I. Pigment Blue 15:3 master batch is blended with the following process conditions: barrel temperature of 140° C., die head temperature of 140° C., screw speed of 250 RPM and average residence time of about five minutes. The mixture is then cooled and pulverized in a ball mill (available from Paul O. Abbe, Inc., Little Falls, N.J. 07424) to coarse particles with a number averaged size of approximately 70 microns.

Into a 2000-ml round-bottom flask equipped with an impeller-type agitator, 500 grams of poly(ethylene glycol) with the number average molecular weight of 400 (commercially available from Aldrich Chemical Company, Milwaukee, Wis.), 12.5 grams of a non-ionic surfactant, Genapol-26-L-1 (commercially available from Clariant Corporation, Charlotte, N.C.) and 500 grams of the above coarse particles are charged. The mixture is then heated to 140° C. and maintained at the temperature for 60 minutes under agitation at 100 rpm. The mixture forms a milky dispersion and the dispersion is then allowed to cool down to ambient temperature. The treated particles are separated from the reaction mixture by filtration and the entrained solvent in the filter cake is washed off by dispersing the filter cake in methanol and filtered again. The filtered particles are dried at 40° C. under vacuum for 16 hours. 100 parts by weight of the dry particles are blended with 1 parts by weight of Cab-O-Sil®TG-308F (a fumed silica acting as a flowability improvement aid from Cabot Corporation, Tuscola, Ill.) for 15 minute in a roll mill, whereby a cyan toner No. 3 is obtained according to the present invention.

The resulting cyan toner with a cycloolefin binder resin contained 96 wt. percent of the polyester resin and 4 wt. percent of C.I. Pigment Blue 15:3, which pigment had a particle size of 0.1 micron average particle diameter as measured by transmission electron microscopy. When the particle size is determined, the number average particle size is significantly reduced to 4.0 microns. Scanning electron microscopy examination of the toner particles shows that the particles are spherical with smooth surface texture.

Comparative Example

When the dispersion process is applied to a high molecular weight resin, or a high melt viscosity resin, the coarse particles do not segregate into fine particles. For example, a high molecular weight propoxylated bisphenol-A polyester resin (Fine Tone™ 382ES-HMW with the weight average molecular weight of 81700, commercially available from Reichold Chemicals, Incorporated, Research Triangle Park, N.C.) was pulverized in a ball mill (available from Paul O. Abbe, Inc., Little Falls, N.J. 07424) to coarse particles with a number averaged size of approximately 70 microns.

Into a 2000-ml round-bottom flask equipped with an impeller-type agitator, 500 grams of Isopar-L®, 12.5 grams of Ganex V-220 and 500 grams of the above coarse particles are charged. The mixture is then heated to 140° C. and maintained at the temperature for 60 minutes under agitation at 100 rpm. The mixture forms a milky dispersion and the dispersion is then allowed to cool down to ambient temperature. The treated particles are separated from the reaction mixture by filtration and the entrained solvent in the filter cake is washed off by dispersing the filter cake in isohexane and filtered again. The filtered particles are dried at 40° C. under vacuum for 16 hours.

The resulting particles have the number average diameter of 54 microns, indicating that the shearing action and the surfactant cannot reduce the particle size significantly to a level suitable for high-resolution toner application.

While the embodiment has been illustrated and described in connection with numerous embodiments, variations within the spirit and scope of the present invention which is set forth in the appended claims will be readily apparent to those of skill in the art.

What is claimed is:

1. A process for preparing a finely divided, comminuted particulate toner composition for developing latent electrostatic images comprising:

(a) preparing a first particulate resin composition including a resin component having a weight average molecular weight in the range of from 5000 g/mol to about 40,000 g/mol and a pigment component and optionally including a charge control agent;

(b) dispersing said first particulate pigmented resin composition in an organic medium including a surfactant, said resin being substantially insoluble in said organic medium;

(c) comminuting said first particulate resin composition in said organic medium by way of application of shear thereto at an elevated temperature; and (d) recovering the comminuted particulate toner composition from said organic medium.

2. The method according to claim 1, wherein the toner particles of said comminuted toner composition are substantially spherical in shape and have a volume average diameter in the range of from about one to about 10 microns, with at least 95 percent of said particles having a diameter in the range of from about 2 to about 15 microns.

3. The method according to claim 1, wherein said step of comminuting said first particulate resin composition is carried out at a temperature of from about 30° C. to about 150° C. above the glass transition temperature of the resin component.

4. The method according to claim 1, wherein said resin is a polyester resin.

5. The method according to claim 4, wherein said polyester resin is an amorphous polyester resin with a glass transition temperature in the range of from about 40 to about 90° C.

6. The method according to claim 1, wherein said polymer resin component comprises a cycloolefin copolymer resin.

7. The method according to claim 6, wherein said cycloolefin copolymer resin includes the residue of an alpha-olefin and a polycyclic olefin selected from the group consisting of norbornene, tetracyclododecene and mixtures thereof.

8. The method according to claim 7, wherein said cycloolefin copolymer resin is an ethylene/norbornene copolymer.

9. The method according to claim 1, wherein said polymer resin is a styrene copolymer resin.

10. The method according to claim 1, wherein said first particulate resin composition is prepared by melt compounding said resin component with said pigment component.

11. The method according to claim 1, wherein said pigment component is selected from cyan pigments, yellow pigments, magenta pigments and black pigments.

12. The method according to claim 1, wherein said pigment component is a master batch in which the pigment is predispersed in said resin.

13. The method according to claim 12, wherein said master batch is produced by flushing a solvent from a mixture comprising the pigment, a solvent, and the resin.

14. The method according to claim 1, wherein a charge control agent is dispersed in the resin in a molten state.

15. The method according to claim 14, wherein said charge control agent is selected from positive charge control agents and negative control agents.

16. The method according to claim 1, wherein said pigment component and a charge control agent are dispersed in said resin component in the molten state and further wherein the mixture is cooled and pulverized to produce particles of an average particle size in the range of from about 50 microns to about 200 microns.

17. The method according to claim 1, wherein said comminuted particle toner composition has a volume average particle size of from about 2 to about 10 microns.

18. The method according to claim 17, wherein said comminuted particulate toner composition has a volume average particle size of from about 2 to about 4 microns.

19. The method according to claim 17, wherein said comminuted particulate toner composition has a volume average particle size of from about 5 to about 8 microns.

20. The method according to claim 1, wherein at least 80 percent of the particles of said comminuted particulate toner composition are within from about 0.5 to about 1.5 times the volume average particle size of said comminuted particulate toner composition.

21. The method according to claim 1, wherein the solubility parameter of the organic medium is different from the solubility parameter of the resin component by at least about one.

22. The method according to claim 21, wherein the solubility parameter of the organic medium is different from the solubility parameter of the resin component by at least about two.

23. The method according to claim 1, wherein said organic medium comprises a paraffin solvent.

24. The method according to claim 1, wherein said organic medium comprises a poly(ethylene glycol).

25. The method according to claim 1, wherein said surfactant is a non-ionic surfactant.

26. The method according to claim 25, wherein said non-ionic surfactant contains the residue of an ethylene oxide moiety.

27. The method according to claim 25, wherein said non-ionic surfactant contains the residue of an propylene oxide moiety.

28. The method according to claim 1, wherein said organic medium comprises an organic solvent and a surfactant and wherein said surfactant is present in an amount of from about 0.2 to about 15 percent by weight of the amount of solvent present.

29. The method according to claim 28, wherein said surfactant is present in an amount of from about 1 to about 10 percent by weight of the amount of solvent present.

30. The method according to claim 1, wherein said first particulate resin composition is present in an amount from about 10 to about 70 volume percent of the combined volume of said first particulate resin composition and said organic medium during the step of comminuting said first particulate resin composition.

31. The method according to claim 30, wherein said first particulate resin composition is present in an amount of from about 20 to about 50 volume percent of the combined volume of said first particulate resin composition and said organic medium during the step of comminuting said first particulate resin composition.

32. The method according to claim 1, wherein the organic medium containing the first particulate resin composition is maintained at said elevation temperature which is higher than the glass transition temperature of said resin component of said first particulate resin composition.

33. The method according to claim 32, wherein said elevated temperature is at least about 30° C. higher than the glass transition temperature of said resin component of said first particulate resin composition.

34. The method according to claim 33, wherein the organic medium containing the first particulate resin composition is maintained at said elevated temperature for between about five and about 60 minutes.

35. The method according to claim 1, further comprising incorporating a flow improvement agent to said comminuted particulate toner composition.

36. The method according to claim 35, wherein said flow improvement agent comprises fumed silica.

37. A particulate toner composition comprising pigmented toner resin particles that are substantially spherical in shape, have an average diameter of from about 1 to 10 microns, with at least about 95 percent of the particles having a volume average diameter in the range of from about 2 to about 15 microns prepared by comminuting a precursor particulate composition in an organic medium under shear at elevated temperature wherein said particles are substantially insoluble in said organic medium and wherein further said particles include a resin component having a weight average molecular weight in the range of from about 5000 g/mol to about 40,000 g/mol.

38. The particulate toner composition according to claim 37, wherein said resin is a polyester resin.

39. The particulate toner composition according to claim 37, wherein said resin is a cycloolefin copolymer.

40. The particulate toner composition according to claim 39, wherein said cycloolefin copolymer is a norbornene/ethylene copolymer.

41. The particulate toner composition according to claim 37, further comprising carrier particles wherein said carrier particles are selected from the group consisting of ferrite, steel and iron powder having a surface active agent coated thereon.

42. A particulate toner composition comprising a polyester resin component and a pigment component wherein the particles are substantially spherical in shape and have a volume average diameter in the range of from about 1 to about 10 microns with at least 95 percent of said particles having a diameter in the range of from about 2 to about 15 microns and wherein said polyester resin component comprises a polyester resin having a weight average molecular weight in the range of from about 5000 g/mol to about 40,000 g/mol.

43. A particulate toner composition comprising a cycloolefin copolymer resin component and a pigment component wherein the particles are substantially spherical in shape and have a volume average diameter in the range of from about 1 to about 10 microns with at least 95 percent of said particles having a diameter in the range of from about 2 to about 15 microns and wherein said cycloolefin copolymer resin component comprises a cycloolefin copolymer having a weight average molecular weight in the range of from about 5000 g/mol to about 40,000 g/mol.

44. The particulate toner composition according to claim 43, wherein said cycloolefin copolymer resin has a weight average molecular weight of about 20,000 g/mol or less.

45. The particulate toner composition according to claim 43, wherein said cycloolefin copolymer resin component comprises a norbornene copolymer.

* * * * *